US011376188B2

(12) United States Patent
Wilt et al.

(10) Patent No.: US 11,376,188 B2
(45) Date of Patent: Jul. 5, 2022

(54) APPARATUS FOR PELVIC FLOOR MUSCLE TRIGGER POINT THERAPY

(71) Applicant: Plus EV Holdings Inc., North Kansas City, MO (US)

(72) Inventors: Aaron Wilt, North Kansas City, MO (US); Amanda Olson, Medford, OR (US)

(73) Assignee: PLUS EV HOLDINGS INC., North Kansas City, MO (US)

( * ) Notice: Subject to any disclaimer, the term of this patent is extended or adjusted under 35 U.S.C. 154(b) by 224 days.

(21) Appl. No.: 16/524,877

(22) Filed: Jul. 29, 2019

(65) Prior Publication Data

US 2021/0030620 A1 Feb. 4, 2021

(51) Int. Cl.
*A61H 23/02* (2006.01)

(52) U.S. Cl.
CPC ..... *A61H 23/02* (2013.01); *A61H 2201/0153* (2013.01); *A61H 2201/1628* (2013.01); *A61H 2201/5007* (2013.01); *A61H 2205/087* (2013.01)

(58) Field of Classification Search
CPC ..... A61H 39/00–06; A61H 2039/005; A61H 23/00–06; A61H 21/00; A61H 2201/0153; A61H 2201/1628; A61H 2201/5007; A61H 2205/086; A61H 2205/087
USPC ..... 601/46
See application file for complete search history.

(56) References Cited

U.S. PATENT DOCUMENTS

| | | | | |
|---|---|---|---|---|
| 7,695,489 | B2 * | 4/2010 | Brockman | A61N 1/36007 606/197 |
| D845,501 | S * | 4/2019 | Janapol | D24/215 |
| 2004/0186344 | A1 * | 9/2004 | Jannuzzi | A61H 19/44 600/38 |
| 2004/0249324 | A1 * | 12/2004 | Louis | A61H 7/003 601/135 |
| 2014/0088469 | A1 * | 3/2014 | Wise | A61H 19/40 601/46 |
| 2019/0209426 | A1 * | 7/2019 | Swartz | A61H 19/00 |
| 2021/0022949 | A1 * | 1/2021 | Janapol | A61H 23/02 |

* cited by examiner

*Primary Examiner* — Valerie L Woodward
*Assistant Examiner* — Paige Kathleen Bugg
(74) *Attorney, Agent, or Firm* — Workman Nydegger

(57) ABSTRACT

An apparatus for pelvic floor muscle trigger point therapy is disclosed. The apparatus comprises a wand to facilitate the release of one or more trigger points in a pelvic floor muscle of a patient. The wand comprises a central portion extending between a first end and a second end. The central portion includes a first bend and a second bend wherein the first bend is formed between a first end region and a first central region. The second bend is formed between the first central region and a second central region. The first end is configured to be vaginally insertable while the second end configured to be rectally insertable. A power source in electrical communication with one or more switches to selectively control a vibration element during use.

19 Claims, 3 Drawing Sheets

APPARATUS FOR PELVIC FLOOR MUSCLE TRIGGER POINT THERAPY

TECHNICAL FIELD

The embodiments generally relate to medical devices for relieving pelvic discomfort in men and women.

BACKGROUND

Pelvic pain is a common problem in men and women alike. Conventional medicine has treated pelvic pain in various ways depending on the source of pain. In some patients, an organ-specific focus is required for treating pelvic pain caused by inflammation in the bladder, prostate gland, or uterus. Also, the pudendal nerve may be entrapped, requiring the release of the nerve. In other instances, an autoimmune process or psychiatric problems may be the cause of discomfort in the pelvic region.

In recent years, it has been found that the majority of pelvic pain is related to muscle dysfunction and muscle-related strain. In particular, myofascial pelvic pain (MFPP) can be diagnosed in women by performing vaginal digital palpation of the pelvic floor muscles during routine gynecological exams to examine for the presence of myofascial pelvic pain and trigger points.

Myofascial trigger points are localized painful lumps or nodules in the muscles or associated connective tissue known as fascia, which may be found in various areas of the pelvic floor. In particular, the pelvic floor muscles consist of the superficial muscle layer and the deep muscle layer, which may each contribute to pelvic discomfort. Treatment may be performed in a medical setting or at home. Previously known self-treatment techniques have proven ineffective for an internal trigger point release. The current arts include devices not designed for trigger point release and may be dangerous if attempted due to their unsuitable sizes and configurations.

SUMMARY OF THE INVENTION

This summary is provided to introduce a variety of concepts in a simplified form that is further disclosed in the detailed description of the embodiments. This summary is not intended to identify key or essential inventive concepts of the claimed subject matter, nor is it intended for determining the scope of the claimed subject matter.

The embodiments described herein provide an apparatus for pelvic floor muscle trigger point therapy. The apparatus comprises a wand to facilitate the release of one or more trigger points in a pelvic floor muscle of a patient. The wand comprises a central portion extending between a first end and a second end. The central portion includes a first bend and a second bend wherein the first bend is formed between a first end region and a first central region. The second bend is formed between the first central region and a second central region. The first end is configured to be vaginally insertable while the second end is configured to be rectally insertable. A power source in electrical communication with one or more switches to selectively control a vibration element during use.

The apparatus is insertable into the vagina or rectum of the user by orienting the upper surface of the wand upwards. Once inserted, the apparatus may be rotated to access pelvic floor muscles in various regions. Using the bends, the first and second ends aid in the access and release of the trigger points.

In one aspect, the wand includes an exterior surface constructed of medical-grade silicone to reduce discomfort during insertion.

In one aspect, the first end comprises a tapered portion to facilitate vaginal insertion and the release of the one or more trigger points. The second end comprises a rounded edge to facilitate rectal insertion and the release of the one or more trigger points.

In one aspect, the first bend is arranged to have a more acute angle than the second bend.

In one aspect, the apparatus is configured to aid in the release of the trigger points of the puborectalis muscle and the obturator internus muscle.

In one aspect, a diameter of the first end region is larger than a diameter of the second end region.

BRIEF DESCRIPTION OF THE DRAWINGS

A complete understanding of the present embodiments and the advantages and features thereof will be more readily understood by reference to the following detailed description when considered in conjunction with the accompanying drawings wherein.

DETAILED DESCRIPTION

Figure 1:
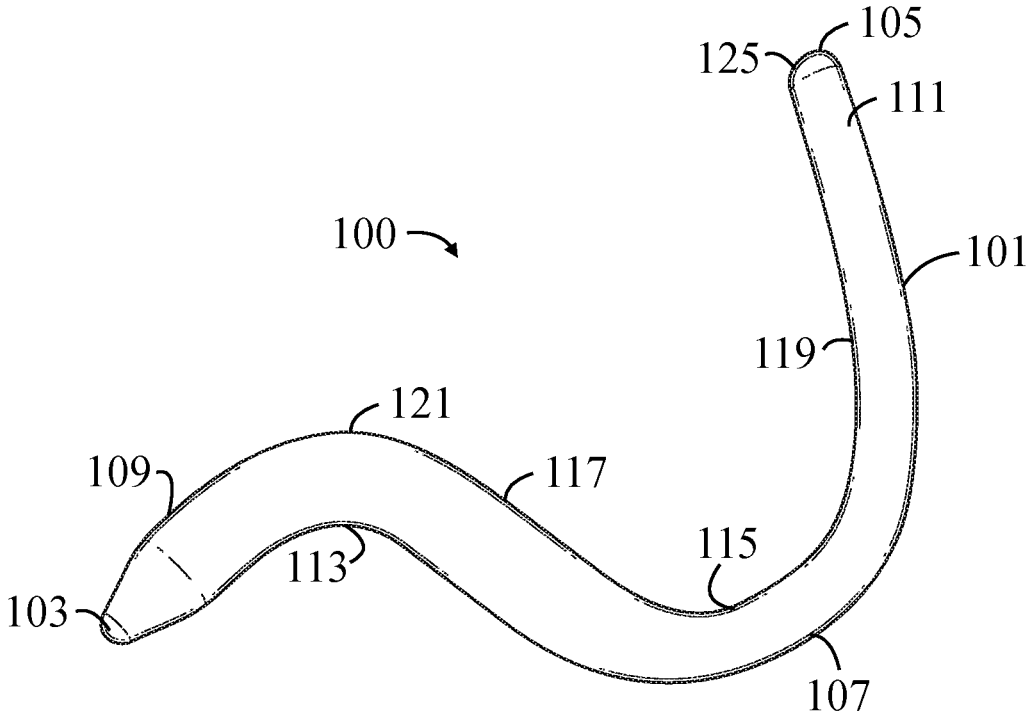
FIG. 1 illustrates a top plan view of the pelvic trigger point release apparatus, according to some embodiments.

The specific details of the single embodiment or variety of embodiments described herein are to the described apparatus and methods of use. Any specific details of the embodiments are used for demonstration purposes only, and no unnecessary limitations or inferences are to be understood therefrom.

Before describing in detail exemplary embodiments, it is noted that the embodiments reside primarily in combinations of components and procedures related to the apparatus and method of use thereof. Accordingly, the apparatus components have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

In general, the embodiments described herein relate to a pelvic trigger point release apparatus suitable for pelvic trigger point release and similar therapies related to myofascial pelvic pain. The apparatus is inserted into the body cavity or applied externally to relieve pain experienced by the patient. The apparatus may perform strumming, stroking, and other methods of trigger point release on the internal pelvic trigger points and other discomforts associated with pelvic floor pain.

As used herein, the term "user" relates to a patient, a care provider (such as a physician, osteopath, nurse, or physical therapist), or another person who uses the apparatus to relieve myofascial pelvic pain. The user may provide care to others or may utilize the apparatus for self-treatment.

Pelvic floor trigger points may include areas of the muscles of the levator ani, coccygeus, pubococcygeus, puborectalis, obturator internus, piriformis, and other internally accessed trigger points. The apparatus may also stretch or otherwise stimulate contracted or shortened the internal pelvic floor muscles. The pelvic floor trigger points may be taut bands within the muscle, which can be present at the surface of the muscle, inside the muscle, in the belly of the muscle, or at the attachment(s) of the muscle. Further, the associated connective tissue may be affected by the apparatus provided in the various embodiments herein.

Figure 2:
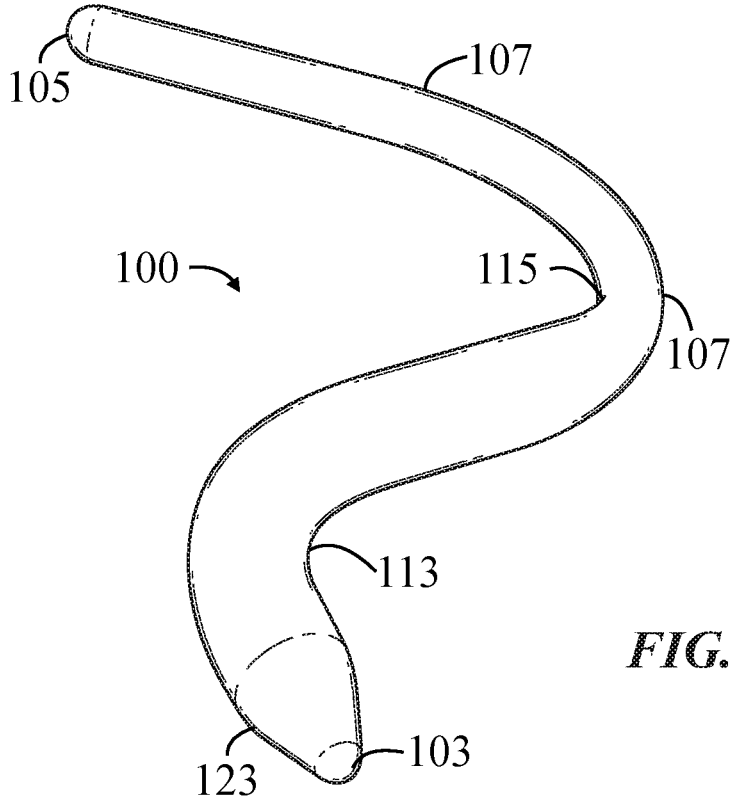
FIG. 2 illustrates a perspective view of the pelvic trigger point release apparatus, according to some embodiments.
Figure 3:
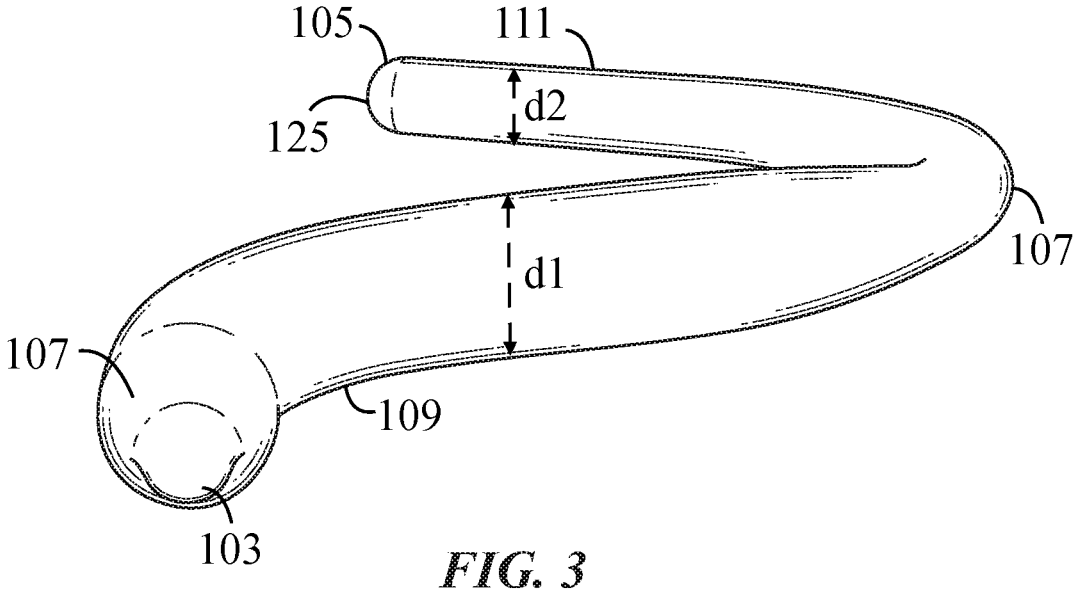
FIG. 3 illustrates a front perspective view of the pelvic trigger point release apparatus, according to some embodiments.

In reference to FIGS. 1-3, there is shown an apparatus 100 in accordance with some embodiments. The apparatus 100 comprises a substantially s-shaped rod or wand 101 having a first end 103 and a second end 105. A central portion 107 is continuous between the first end 103 and the second end 105 such that the wand 101 is a continuous member. The first end region 109 which extends from the central portion 107 and terminates at the first end 103, has a larger diameter (shown as d1 in FIG. 3) than the diameter of the second end region 111 (shown as d2 in FIG. 3) which terminates in the second end 105. The central portion 107 comprises a first bend 113 and a second bend 115, which are integral in permitting the first end 103 and the second end 105 to access and effectively relieve the trigger point(s).

In further reference to FIGS. 1-3, the angle, and orientation of the first bend 113 with respect to the second bend 115 is important for properly relieving pain in the various pelvic floor muscles. In such, the first bend 113 is more acute than the second bend 115. The first bend 113 forms a substantially 90° bend between the first end region 109 and a first central region 117. The first bend may be greater or less than 90°. However, the angle of the first bend is less than the angle of the second bend 115, which is more obtuse. The second bend 115 is formed between the first central region 117 and the second central region 119.

In some embodiments, the first end 103 is configured for vaginal insertion into a patient due to the arrangement of the first bend 113 being advantageous for accessing the pelvic floor muscles in the vagina. The user inserts the first end 103 while orienting the apparatus 100 such that the upper surface 121 (as shown in FIG. 1) is facing upwards. Once inserted, the user may rotate the apparatus 100 to access the front, side, or rear pelvic floor muscles. As shown in FIG. 2, the first end 103 comprises a tapered portion 123 terminating in a rounded edge to facilitate the release of the trigger point.

In some embodiments, the second end 105 is configured for rectal insertion into a patient due to the decreased diameter of the second end region 111 as well as the second bend 115 providing an advantageous configuration for releasing trigger points of the pelvic floor muscles which are accessed via the rectum. The rounded edge 125 of the second end 105 is useful for properly releasing trigger points in the pelvic floor muscles.

The apparatus 100 is substantially slender such that the diameter is sufficient to provide strength to the apparatus 100 during insertion and to allow the user to apply pressure during treatment protocols without undue deformation of the apparatus 100. Further, the apparatus 100*r* should be slender enough in diameter so that vaginal and/or rectal insertion of the apparatus 100 does not result in undue discomfort to the patient, while allowing the patient ability to feel the engagement of the first end 103 or second end 105 of the apparatus with a trigger point.

The apparatus 100 may be hollow or solid in construction, or a combination of each to allow for the disposal of internal components such as actuators, vibration elements, electrical circuitry, power sources, etc.

In some embodiments, the apparatus has an exterior constructed of medical-grade silicone, which is advantageous for providing a smooth surface to reduce discomfort when inserting the device and during use.

Figure 4:
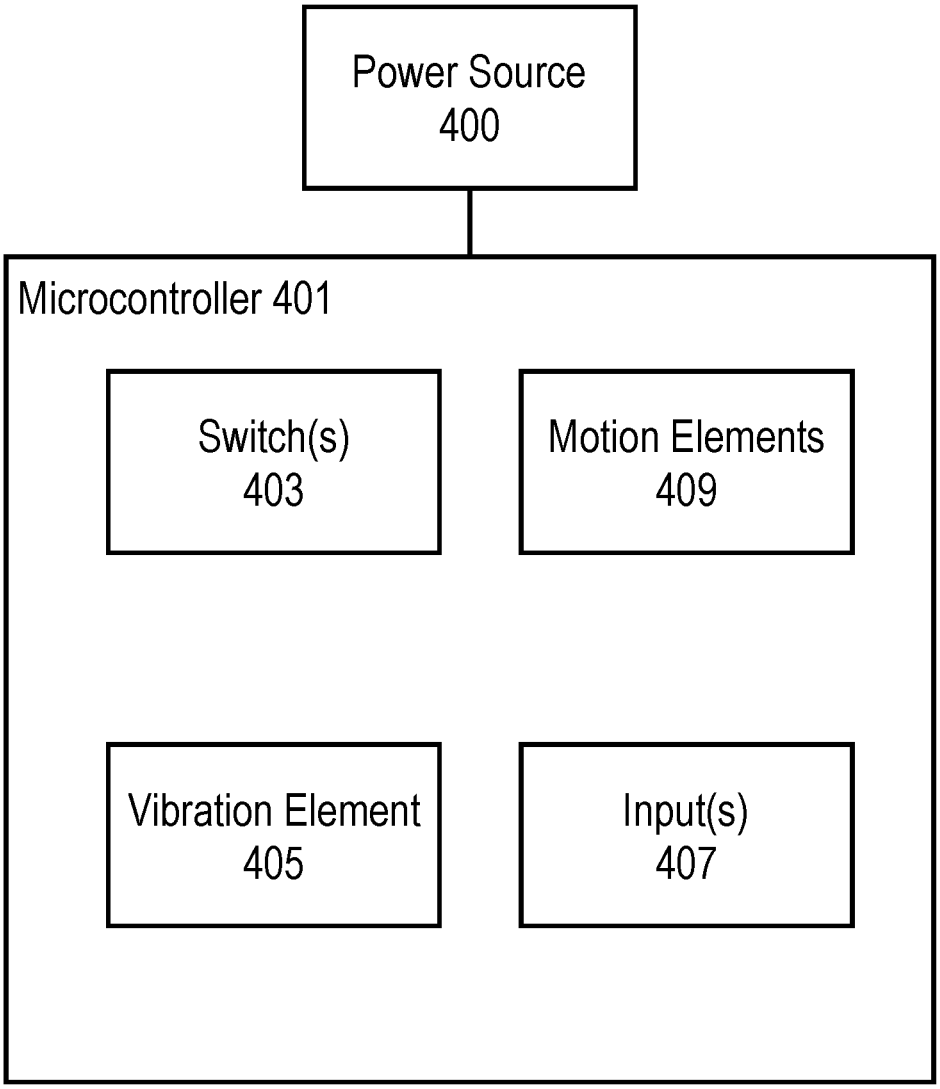
FIG. 4 illustrates a block diagram of the electrical components, according to some embodiments.

FIG. 4 illustrates a block diagram of the electrical components comprising a power source 400 in electrical communication with a microcontroller 401 in electrical communication with one or more switches 403 which allow the user to turn the apparatus on and off, or to cycle through various operating functions of the apparatus. Operating functions may include vibration settings such as vibration patterns and vibration intensity controlled by the vibration element 405. One or more inputs 407 may be provided, which may allow the user to alter the configuration, size, or shape of the apparatus. For example, the inputs 407 may affect motion elements 409 (such as actuators) in the first and second bends to permit the user to alter the angle of each bend simultaneously or independently. Other user-selectable characteristics may include heating and cooling settings, motion settings, or other functionalities known in the arts.

Many different embodiments have been disclosed herein, in connection with the above description and the drawings. It will be understood that it would be unduly repetitious and obfuscating to describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

An equivalent substitution of two or more elements can be made for anyone of the elements in the claims below or that a single element can be substituted for two or more elements in a claim. Although elements can be described above as acting in certain combinations and even initially claimed as such, it is to be expressly understood that one or more elements from a claimed combination can in some cases be excised from the combination and that the claimed combination can be directed to a subcombination or variation of a subcombination.

It will be appreciated by persons skilled in the art that the present embodiment is not limited to what has been particularly shown and described hereinabove. A variety of modifications and variations are possible in light of the above teachings without departing from the following claims.

What is claimed is:

1. An apparatus for pelvic floor muscle trigger point therapy, the apparatus comprising:

a wand structured to facilitate a release of one or more trigger points in a pelvic floor muscle of a patient, wherein:

the wand comprises:

a first end region at a first end, a second end region at a second end, a central portion extending between the first end and the second end, wherein the central portion includes:

a first central region extending between the first end region and a center of the wand, and a second central region extending between the second end region and the center of the wand, a first bend, a second bend, wherein:

the first bend is formed between the first end region and the first central region, the second bend is formed between the first central region and the second central region, the first bend has a first angle of curvature, the second bend has a second angle of curvature that is greater than the first angle of curvature, the second angle being an obtuse angle;

the first end is configured to be vaginally insertable, and the second end is configured to be rectally insertable; and a power source is in electrical communication with one or more switches to selectively control a vibration element included in the apparatus, a portion of the apparatus comprising (i) the first central region, (ii) the second bend, (iii) the second central region, and (iv) the second end, has a shape approximating that of a non-circular half ellipse, a region between the first bend and the first central portion forms a first terminal end of the non-circular half ellipse and the second end forms a second terminal end of the non-circular half ellipse, and wherein an axis that extends along the first end towards the second end intersects the second end region.

2. The apparatus of claim 1, wherein the wand includes an exterior surface constructed of medical-grade silicone to reduce discomfort during insertion.

3. The apparatus of claim 2, wherein the first end comprises a tapered portion to facilitate vaginal insertion and the release of the one or more trigger points.

4. The apparatus of claim 3, wherein the second end comprises a rounded edge to facilitate rectal insertion and the release of the one or more trigger points.

5. The apparatus of claim 1, wherein the apparatus is configured to aid in the release of the one or more trigger points of a puborectalis muscle and an obturator internus muscle.

6. An apparatus for pelvic floor muscle trigger point therapy, the apparatus comprising:

a first end region at a first end suitable for vaginal insertion;

a second end region at a second end suitable for rectal insertion;

a central portion extending between the first end and the second end, the central portion comprising:

a first central region extending between the first end region and a center of the apparatus; and a second central region extending between the second end region and the center of the apparatus;

a first bend formed between the first end region and the first central region to facilitate the release of trigger points of pelvic floor muscles accessible via vaginal insertion of the first end;

a second bend formed between the first end region and the second central region to facilitate the release of the trigger points of pelvic floor muscles accessible via rectal insertion, wherein the first bend has a first angle of curvature, and the second bend has a second angle of curvature that is greater than the first angle of curvature, and the first angle of curvature and the second angle of curvature are formed in a manner causing the first end to point in a first direction, and the second end to point at a second direction that intersects the first direction; and a power source in electrical communication with one or more switches to selectively control a vibration element included in the apparatus and one or more actuators positioned within the apparatus to permit a user to selectively change the first angle of curvature of the first bend and the second angle of curvature of the second bend, wherein a portion of the apparatus comprising (i) the first central region, (ii) the second bend, (iii) the second central region, and (iv) the second end, has a shape approximating that of a non-circular half ellipse, and wherein a region between the first bend and the first central portion forms a first terminal end of the non-circular half ellipse and the second end forms a second terminal end of the non-circular half ellipse, and wherein an axis that extends along the first end towards the second end intersects the second end region.

7. The apparatus of claim 6, wherein the apparatus includes an exterior surface constructed of medical-grade silicone to reduce discomfort during insertion.

8. The apparatus of claim 7, wherein the first end comprises a tapered portion to facilitate vaginal insertion and the release of the trigger points.

9. The apparatus of claim 8, wherein the second end comprises a rounded edge to facilitate rectal insertion and the release of the trigger points.

10. The apparatus of claim 9, wherein the first bend is arranged to have a more acute angle than the second bend.

11. The apparatus of claim 10, wherein the apparatus is configured to aid in the release of the trigger points of at least a puborectalis muscle or an obturator internus muscle.

12. The apparatus of claim 11, wherein a diameter of the first end region is larger than a diameter of the second end region.

13. An apparatus for pelvic floor muscle trigger point therapy, the apparatus comprising:

a medical-grade silicone wand comprised of:

a first end region at a first end suitable for vaginal insertion;

a second end region at a second end suitable for rectal insertion;

a central portion extending between the first end region and the second end, the first end comprising a tapered region extending between the first end region and the first end, the second end comprising a rounded edge, the central portion comprising:

a first central region extending between the first end region and a center of the apparatus; and a second central region extending between the second end region and the center of the apparatus;

a first bend formed between the first end region and the first central region to facilitate a release of trigger points of pelvic floor muscles accessible via vaginal insertion of the first end;

a second bend formed between the first end region and the second central region to facilitate the release of trigger points of pelvic floor muscles accessible via rectal insertion, wherein the first bend has a first angle of curvature, and the second bend has a second angle of curvature that is greater than the first angle of curvature, and the first angle of curvature and the second angle of curvature are formed in a manner, causing the first end to point at a first direction, and the second end to point at a second direction that is not in parallel with the first direction; and a power source in electrical communication with one or more switches to selectively control a vibration element included in the apparatus and one or more actuators positioned within the apparatus to permit a user to selectively change the first angle of curvature of the first bend and the second angle of curvature of the second bend to selectively access a puborectalis muscle and an obturator internus muscle, wherein a portion of the apparatus, comprising (i) the first central region, (ii) the second bend, (iii) the second central region, and (iv) the second end, has a shape approximating that of a non-circular half ellipse, wherein a region between the first bend and the first central region forms a first terminal end of the non-circular half ellipse and the second end forms a second terminal end of the non-circular half ellipse, and wherein an axis that extends along the first end toward the second end intersects the second end region.

14. The apparatus of claim 13, wherein a diameter of the first end region is larger than a diameter of the second end region.

15. The apparatus of claim 13, wherein the vibration element is programmable with a plurality of vibration patterns and a plurality of vibration intensities.

16. The apparatus of claim 13, wherein the one or more actuators are controlled independently.

17. The apparatus of claim 13, further comprising a second tapered portion between the first central region and the second central region.

18. The apparatus of claim 13, wherein the apparatus is rotatable during vaginal insertion and rectal insertion, wherein rotation of the apparatus facilitates trigger point release.

19. The apparatus of claim 13, wherein the apparatus is inserted by orienting an upper surface to face upwards.

* * * * *